United States Patent [19]

Haissig

[11] Patent Number: 4,592,408

[45] Date of Patent: Jun. 3, 1986

[54] DEVICE FOR HORIZONTAL CONTINUOUS CASTING OF METALS AND ALLOYS

[75] Inventor: Manfred Haissig, 31 Foxhill, Irvine, Calif. 97214

[73] Assignee: Manfred Haissig, Irvine, Calif.

[21] Appl. No.: 788,662

[22] Filed: Oct. 17, 1985

Related U.S. Application Data

[63] Continuation of Ser. No. 470,267, Feb. 28, 1983, abandoned.

[51] Int. Cl.[4] ..... B22D 11/128; B22D 11/20

[52] U.S. Cl. ..... 164/413; 164/440; 164/441; 164/442

[58] Field of Search ..... 164/413, 440, 441, 442

[56] References Cited

U.S. PATENT DOCUMENTS

| | | | |
|---|---|---|---|
| 3,504,732 | 4/1970 | Wertli | 164/440 |
| 3,506,063 | 4/1970 | Dain | 164/440 X |
| 3,540,523 | 11/1970 | Wertli | 164/440 |
| 3,563,297 | 2/1971 | Wertli | 164/440 X |
| 4,018,261 | 4/1977 | Scheinecker et al. | 164/448 |

FOREIGN PATENT DOCUMENTS

| | | |
|---|---|---|
| 277489 | 12/1969 | Austria . |
| 1583611 | 8/1970 | Fed. Rep. of Germany . |
| 2340636 | 2/1975 | Fed. Rep. of Germany . |

*Primary Examiner*—Nicholas P. Godici
*Assistant Examiner*—J. Reed Batten, Jr.
*Attorney, Agent, or Firm*—Brumbaugh, Graves, Donohue & Raymond

[57] ABSTRACT

In a horizontal continuous casting plant which includes a mold and an oscillatory withdrawal device downstream of the mold, the withdrawal device is positioned along the strand path, by a computer-controlled motor, at a point such that the strand will not be damaged or impaired by the pressure applied to it by the strand engagement elements of the withdrawal device. Preferably, the strand engagement elements comprises one or more pairs of rollers which also are adjustable, by computer-controlled motors, to a desired elevation and separation to accommodate a range of cross-sectional dimensions of the strand.

2 Claims, 2 Drawing Figures

DEVICE FOR HORIZONTAL CONTINUOUS CASTING OF METALS AND ALLOYS

This application is a continuation of application Ser. No. 470,267, filed on Feb. 28, 1983 and now abandoned.

BACKGROUND OF THE INVENTION

This invention relates to a device for horizontal continuous casting of metals or alloys, in particular steels, having as essential components a cooled ingot mold and a strand withdrawal device displaceable in the direction of the longitudinal axis of the strand, with aftercoolers optionally connected downstream of the mold and before the withdrawal device.

In horizontal continuous casting of metals, the strand formed in the casting mold, which has not yet completely solidified, is drawn out of the mold by means of the strand withdrawal device. In particular with alloys melting at elevated temperatures, such as, for instance, steels, the strand withdrawal occurs preferably in steps. By pausing between the individual withdrawal steps or by pushing back of the strand, the contraction occurring during cooling is compensated for, heat cracks are avoided, and solid welding of the individual strand skin sections respectively formed in the mold is achieved.

Basically, two different arrangements of strand withdrawal devices are known. One such arrangement, that is today in lesser use, has clamps that seize the strand and move it in the desired manner. This type of drive is not entirely accurate since the relatively large mass of the jaws must be moved so that gears of corresponding size having relatively large clearances must be used. Moreover, the danger of damaging the strand surface is presented by such an arrangement.

Preferably, accurate strand withdrawal is accomplished today by means of driving rollers or pairs of driving rollers which engage the strand directly. Driving rollers guarantee a steady contact between the strand and the withdrawal device, thereby bringing about an accurate withdrawal of the strand.

Representative of the large number of prior art references describing horizontal continuous casting devices, as well as those that relate to strand withdrawal devices; are German Pat. Nos. 1,583,611 and 2,340,636.

In the continuous casting cycle, the metal, after leaving the molten metal container, is subjected to profiling in the ingot mold and to an optional cooling cycle in aftercoolers, during which there occurs a progressive cooling of the strand and an increase in the thickness of the strand skin. After the cast strand has left the ingot mold and the optional aftercoolers, and before it is seized by the strand withdrawal arrangement, e.g., the driving rollers, further cooling takes place. Depending on the shrinkage or expansion behavior of the metal or alloy, dimensional changes also occur along this path, which changes become noticeable, particularly in the longitudinal direction of the strand. In addition to these longitudinal changes, during the cooling and continuous solidification of the strand, which may differ from metal to metal and from alloy to alloy, phase changes may occur within the already solidified strand skin which may result in dimensional constancy rather than the customary shrinkage of the strand during cooling.

In the German Pat. No. 1,583,611 referred to above, there is described a strand withdrawal device in which the driving roller carrying frame is reciprocated in the longitudinal direction of the strand during the strand withdrawal cycle. A strand withdrawal frame, similarly movable in oscillatory fashion in the longitudinal direction of the strand, but that is outfitted with clamping jaws, is disclosed in Austrian Pat. No. 277,489. In these two devices, the points of reversal of the oscillating movement of the frame, or of the strand withdrawal elements, is preset to be constant. Thus, in every cycle of reciprocating movement the initial seizing of the strand by the strand withdrawal elements occurs at the same point along the path of the strand.

As a result, even though the withdrawal device is designed to be movable and moves during withdrawal, the strand withdrawal operation cannot be addressed individually to the specific metal or alloy to be cast and to its specific behavior during the cooling cycle, to insure that the withdrawal elements always engage the strand precisely at the point at which the strand has cooled sufficiently and is strong enough to avoid a break or damage. Since this point differs from metal to metal and, in the same metal, varies according to the cross-sectional dimension of the withdrawn strand, it is necessary, for safety considerations, in order to avoid damaging of the strand and to prevent breaks or the like that affect operations, to maintain the spacing between engagement of the strand by the first strand withdrawal element and the end of the ingot or the aftercooler greater than would be necessary on the basis of the respective "metallurgical length", the depth of the sump, or the like. In plants having an oscillating frame in accordance with the arrangements known in the art, such individual setting of the point at which the strand withdrawal occurs has not been provided for.

SUMMARY OF THE INVENTION

An object of this invention is to provide a device for horizontal continuous casting that enables control of the point of the engagement of an oscillating strand withdrawal device with the strand precisely in accordance with the metal or the alloy then being cast and, if necessary, in accordance with the cross-sectional size of the strand, also taking into account the specific behavior and properties of the strand during controlled cooling in an aftercooler, as well as further cooling along its path after leaving the ingot mold and aftercooler.

A further object of the invention is to provide apparatus for horizontal continuous casting of metals and alloys, particularly steels, which comprises a cooled mold, optional aftercoolers connected downstream thereof, and an oscillatory strand withdrawal device displaceable in the direction of the longitudinal axis of the strand, characterized in that the strand withdrawal frame is capable of being set to any desired constant spacing downstream of the point of the emergence of the strand from the mold, and from the aftercooler, if present, so that the strand withdrawal element, e.g., a pair of driving rolls, will engage the strand at the point determined to be optimum for the metal being cast and the casting conditions. The apparatus of the invention also enables at least the driven roller of the pair of driving rollers on the displaceable withdrawal frame to be adjusted in elevation so to accommodate the height and thickness of the strand being cast.

The longitudinal displaceability of the withdrawal frame in both directions and its ability to be fixed at a desired point along the strand path, according to the invention, permits pinpointing the adjustment of the casting system in a given case to the "metallurgical length" of the strand being withdrawn at a given moment, in other words, the length of the path the strand must traverse after coming out of the mold or the aftercooler before it can without any danger or impairment be seized by the strand withdrawal elements on the frame.

Any suitable means may be employed for effecting longitudinal displacement of the strand withdrawal frame which customarily is borne on tracks via wheels or rollers. A particular advantage of the invention resides in that any existing withdrawal device already in use need be modified only to a minor extent to achieve the disclosed improvement in the manufacture of the strand.

For example, setting of the position of the withdrawal frame in each case to the desired spacing from the end of the aftercooler (or mold) can be carried out by means of a screw drive driven, preferably by a DC stepping motor, which, in turn, is controlled by a central control system, e.g., a microprocessor, in accordance with a set program. This allows a highly accurate setting, easily made, which is attuned to the metal to be cast and the respective size of the strand, i.e., the "metallurgical length" of the strand.

The adjustment in elevation of the strand withdrawal elements, in accordance with the invention, can be effected in the same way as the longitudinal displacement of the frame, such as by means of a screw drive actuated by a DC stepping motor controlled by a microprocessor. By providing elevational as well as longitudinal adjustability of the strand withdrawal elements, there can be achieved not only an accurate longitudinal setting of the strand withdrawal site, adapted to the behavior of the metal or the alloy, but processes that cause size changes in the thickness of the withdrawn strand, i.e., crosswise to the strand axis, can also be taken into account.

The adjustability in height of the withdrawal elements of the longitudinally displaceable withdrawal frame has particular advantage if it is intended to manufacture strands of different cross-sectional size on one casting line, where the strand underside, due to the use of ingot molds and aftercoolers of different cross-sectional sizes, varies in its elevational position. It is possible, in accordance with the invention, to achieve withdrawal that is exactly adapted in its elevation and optimally suited for the cross-section size of the particular strand being cast so that, upon entry of the strand into the drive rollers of the withdrawal elements, the strand is supported without deformation and the transfer of the forces of the withdrawal element to the strand may be held substantially constant.

In a preferred embodiment of the invention that enhances the accuracy of the strand withdrawal process and is particularly suited for, an oscillating strand withdrawal system, the withdrawal means are comprised of pairs of driving rollers on the withdrawal frame, at least one roller of which is coupled directly to the shaft of the actuating motor, or otherwise coupled thereto without slippage or lost motion, the motor preferably being a DC stepping motor. By this means, it is possible to bring about precise setting of the spacing of the point of application of the strand withdrawal element, attuned to the behavior of the particular metal to be processed at a given moment, and also an accurate, slippage-free control of the strand withdrawal process itself, by a mechanically simple structure. Because of the direct relation between the angle of rotation of the motor and the path of travel of the strand, reproducible adjustments can be made with high precision, as a result of which it is possible to perform accurately, complicated sequences of steps requiring minute incremental adjustment.

BRIEF DESCRIPTION OF THE DRAWINGS

The invention is described below in greater detail in conjunction with the appended drawings, in which.

DETAILED DESCRIPTION OF THE INVENTION

Figure 1:
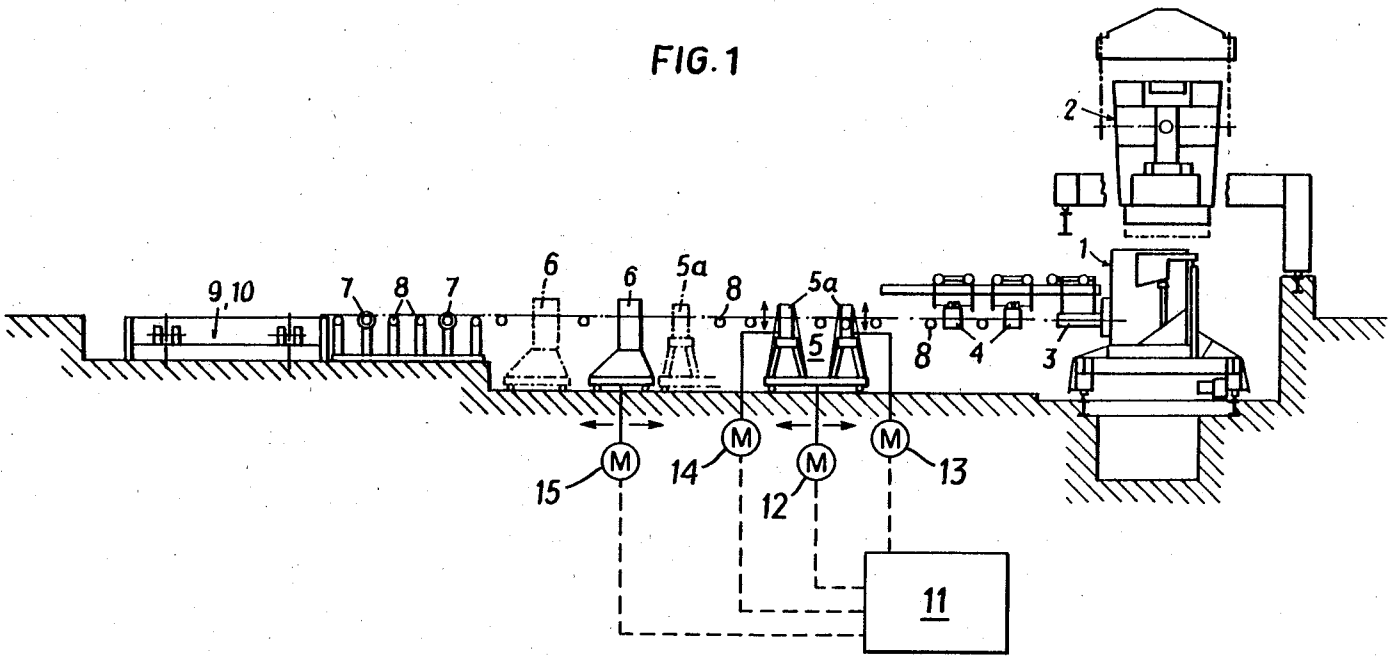
FIG. 1 is an elevational view of a continuous casting plant embodying the present invention.
Figure 2:
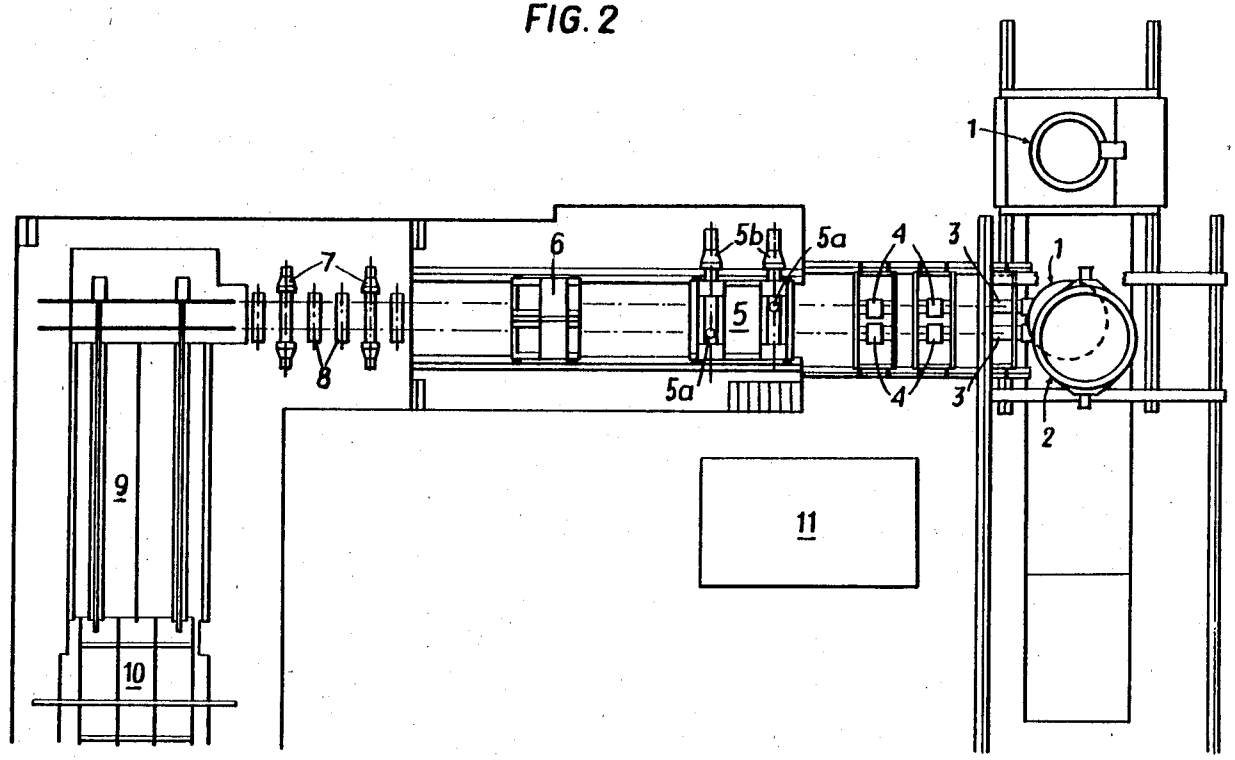
FIG. 2 is a plan view of the continuous casting plant of FIG. 1.

The continuous casting plant according to FIGS. 1 and 2 is made up of the molten metal distributor 1 situated on the distributor carriage above which there is situated the ladle truck with the casting ladle 2 for charging of the distributor. From the distributor, the metal to be cast enters the horizontal ingot mold 3, likewise mounted on a truck, in which there occurs profiling and cooling of the strand. The strand having a solidified strand shell and a fusible core is driven by the electromagnetic stirrer coils 4 that are likewise mounted on the truck and that bring about an inductive revolving of the liquid strand core. Along the strand path, the strand is supported on rollers 8.

The strand is then seized by the withdrawal element or elements 5*a* of the strand-withdrawal frame 5. The withdrawal frame 5 is supported on wheels or rollers and is displaceable in longitudinal direction of the strand. The position of the frame 5 is adjustable in distance from the end of the ingot mold, as indicated by the position of the withdrawal elements 5*a*, shown in dash-dot lines, further away from the mold.

Downstream of the displaceable frame 5 is disposed a strand cutting device 6, such as an hydraulic knife, that is likewise designed to be longitudinally displaceable in correlation with the movement of the strand withdrawal frame 5. Following the knife 6 downstream, are a series of supporting rollers 8 and driving rollers 7 that carry the strand pieces across a cooling bed 9 and a collecting trough 10, seen better in FIG. 2.

To control the movement of the withdrawal frame 5, the withdrawal rollers 5*a* and the knife 6, a digital microprocessor 11 actuates a series of DC stepping motors 12–15, as seen schematically in FIG. 1. The microprocessor and its control of the DC stepping motors constitute a servo system of known type which may be implemented as disclosed in co-pending U.S. patent application Ser. No. 319,917, filed Nov. 10, 1981, for Apparatus for Horizontal Continuous Casting, of which I am a joint applicant.

As seen in FIG. 1, a DC stepping motor 12, under control of digital microprocessor unit 11, moves the withdrawal frame 5 to a desired position along the path of the strand. Similarly, the knife 6 is moved along the strand path by DC stepping motor 15, also under control of the microprocessor 11.

The frame 5 preferably carries two or more sets of withdrawal rollers 5*a*, with at least one roller of each pair being directly driven by a drive motor 5*b* (FIG. 2). As discussed above, the withdrawal rollers engage the strand and move it, in oscillatory fashion, along the path towards the knife 6, in known manner, for example, as described in the aforementioned U.S. patent application Ser. No. 319,917.

The vertical position, i.e., elevation, of the rollers 5*a*, as well as the separation between the rollers of each pair, are set by the DC stepping motors 13,14, under control of the microprocessor 11. A suitable mounting arrangement for the rollers of a withdrawal frame, permitting the foregoing adjustment, is shown in U.S. Pat. No. 4,018,261, the motors 13,14 actuating the linkages by a screw drive, for example, in place of the pneumatic or hydraulic means of the patent.

Not shown in the drawings, is an aftercooler which may be provided between the stirrers 4 and the withdrawal frame 5, to accelerate solidification of the strand, as is known in the art.

In operation, appropriate data reflecting the properties of the metal being cast, the desired cross-sectional area of the strand and the length of the billet are supplied to the microprocessor. The latter then actuates the motors 12–15 to (1) position the withdrawal frame 5 at the proper location to engage the strand at the point at which the danger of fracture or impairment of the strand is past, (2) adjust the heights of the rollers 5*a* to maintain the bottom surface of the strand at the proper height and to accommodate the desired thickness of the strand, and (3) position the knife 6, with respect to the frame 5 to provide the proper billet length. The microprocessor 11 may also control the oscillatory withdrawal of the strand, as in said application Ser. No. 319,917.

While the invention has been described with reference to a particular embodiment thereof, it will be understood that various changes in form and detail may be made without departing from the spirit and scope of the invention, as set forth in the appended claims.

I claim:

1. In apparatus for the horizontal continuous casting of metals or alloys, particularly steels, which includes a mold for forming a strand and a strand withdrawal device horizontally downstream of the mold, and wherein said withdrawal device comprises means for engaging said strand at a point along its path and moving said strand along said path, and said withdrawal device including means for establishing oscillatory movement of said strand along said path about said point of engagement, the improvement comprising menas for adjustably displacing said withdrawal device so as to selectively position said engaging means at a desired predetermined point of engagement along a given length of said strand path, and means for vertically adjusting the position of said engaging means in a direction perpendicular to said horizontal strand path so that said engaging means is aligned with the horizontal center line of said strand.

2. The apparatus of claim 1 wherein said engaging means comprises at least one pair of drive rolls extending transversely of and on either side of said strand.

* * * * *